US008121735B2

(12) United States Patent
Saruwatari et al.

(10) Patent No.: US 8,121,735 B2
(45) Date of Patent: Feb. 21, 2012

(54) CONTROL DEVICE

(75) Inventors: Hirotaka Saruwatari, Sakai (JP); Hiroyuki Matsuura, Sakai (JP); Mario Hayashi, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 497 days.

(21) Appl. No.: 12/306,084

(22) PCT Filed: Jul. 2, 2007

(86) PCT No.: PCT/JP2007/063222

§ 371 (c)(1), (2), (4) Date: Dec. 22, 2008

(87) PCT Pub. No.: WO2008/004515

PCT Pub. Date: Jan. 10, 2008

(65) Prior Publication Data

US 2009/0281666 A1 Nov. 12, 2009

(30) Foreign Application Priority Data

Jul. 3, 2006 (JP) ..... 2006-183701

(51) Int. Cl.
*G06F 19/00* (2006.01)

(52) U.S. Cl. ..... 700/276; 236/94

(58) Field of Classification Search ..... 700/276–278, 700/299; 236/91, 94; 702/105, 188
See application file for complete search history.

(56) References Cited

U.S. PATENT DOCUMENTS

| | | | | |
|---|---|---|---|---|
| 5,924,486 | A * | 7/1999 | Ehlers et al. | 165/238 |
| 6,070,110 | A * | 5/2000 | Shah et al. | 700/278 |
| 6,216,956 | B1 * | 4/2001 | Ehlers et al. | 236/47 |
| 2005/0125102 | A1 * | 6/2005 | Nichols et al. | 700/276 |
| 2005/0149232 | A1 * | 7/2005 | Shah et al. | 700/276 |
| 2005/0159847 | A1 * | 7/2005 | Shah et al. | 700/276 |
| 2005/0259846 | A1 * | 11/2005 | Freeman et al. | 382/103 |

FOREIGN PATENT DOCUMENTS

| | | | |
|---|---|---|---|
| JP | 2002-115891 | A | 4/2002 |
| JP | 2002-372288 | A | 12/2002 |
| JP | 2004-156829 | A | 6/2004 |
| JP | 2006-039876 | A | 2/2006 |
| JP | 2006-165627 | A | 6/2006 |

* cited by examiner

*Primary Examiner* — Kidest Bahta
(74) *Attorney, Agent, or Firm* — Global IP Counselors

(57) ABSTRACT

A control device is configured to control an air conditioner that includes an air conditioner outdoor unit and an air conditioner indoor unit. The control device includes a microcomputer and a storage element. The microcomputer causes a signal to be transmitted and received between an outdoor communication unit of the air conditioner outdoor unit and an indoor communication unit of the air conditioner indoor unit. The storage element stores specific information in response to command from the microcomputer. The microcomputer causes the storage element to store operation information including a state of transmission and reception of the signal of the air conditioner at a constant time interval.

5 Claims, 5 Drawing Sheets

CONTROL DEVICE

CROSS-REFERENCE TO RELATED APPLICATIONS

This U.S. National stage application claims priority under 35 U.S.C. §119(a) to Japanese Patent Application No. 2006-183701, filed in Japan on Jul. 3, 2006, the entire contents of which are hereby incorporated herein by reference.

TECHNICAL FIELD

The present invention relates to a control device of an air conditioner.

BACKGROUND ART

In order to simplify factor analysis when an error occurs in an air conditioner, a conventional air conditioner employs a method in which operation information at the time of occurrence of an error is stored in a memory (for example, see JP-A Publication No. 2004-156829).

SUMMARY OF THE INVENTION

Object to be Achieved by the Invention

However, with the method described in Patent Document 1, because the information provided is the operation information at the time of occurrence of an error, it is insufficient to perform detailed factor analysis.

An object of the present invention is to provide, in case of occurrence of an error in an air conditioner, a control device configured to store information necessary to analyze factors contributing to the error.

Means to Achieve the Object

A control device according to a first aspect of the present invention is a control device that controls an air conditioner configured by an air conditioner outdoor unit and an air conditioner indoor unit, and includes a microcomputer and a storage element (memory). The microcomputer causes a signal to be transmitted and received between an outdoor communication unit provided to the air conditioner outdoor unit and an indoor communication unit provided to the air conditioner indoor unit. The memory stores specific information by a command from the microcomputer. The microcomputer causes the memory to store operation information including a state of transmission and reception of the signal of the air conditioner at a constant time interval.

In this control device, the microcomputer causes the memory to store, as data, the time series of the state of transmission and reception of the signal and the time series of the operation information in case of occurrence of an error in the air conditioner. Accordingly, at the time of occurrence of an error, a change in the data can be analyzed, and thus it is easy to determine whether the error was caused by multiple factors or by external factors. Further, even if there is no error, if an indication of occurrence of an error is detected based on the trend of the data, it is possible to perform maintenance in advance.

A control device according to a second aspect of the present invention is the control device according to the first aspect of the present invention, wherein the memory includes a predetermined number of areas to store the operation information. When the microcomputer causes the memory to store new operation information, if all the areas are used up, the microcomputer writes the new operation information in the area that stores the oldest operation information in an overwriting manner.

In this control device, the microcomputer sequentially updates, from oldest to new, the operation information of the air conditioner stored in the memory. Accordingly, the size of the memory capacity to be used is prevented from becoming large.

A control device according to a third aspect of the present invention is the control device according to the first aspect of the present invention, wherein the operation information includes ambient temperature at a place where the microcomputer and the memory are disposed.

In this control device, the microcomputer causes the memory to store the time series of the ambient temperature in case of occurrence of an error in the air conditioner. Accordingly, it is possible to estimate a change in the behavior of electronic components associated with a temperature change, and this simplifies the narrowing down of error factors.

A control device according to a fourth aspect of the present invention is the control device according to the first aspect of the present invention, wherein the microcomputer calculates a reception error occurrence rate based on the number of times that the outdoor communication unit failed to normally receive a signal from the indoor communication unit in a certain period of time, and causes the memory to store the reception error occurrence rate as the operation information.

In this control device, the microcomputer causes the memory to store the time series of the reception error occurrence rate in case of occurrence of an error in the air conditioner. This simplifies the narrowing down of factors at the time of occurrence of an error in a signal transmission system.

A control device according to a fifth aspect of the present invention is the control device according to the first aspect of the present invention, wherein the memory is nonvolatile.

In this control device, memory contents will not be lost even if the power supply is interrupted.

A control device according to a sixth aspect of the present invention is the control device according to the first aspect of the present invention, wherein the microcomputer transmits the operation information to a terminal device located away from the air conditioner.

In this control device, the microcomputer can notify an air conditioner service provider of the operation state. Alternatively, the air conditioner service provider at a remote location can demand the operation information from the microcomputer. By so doing, the service provider at the remote location can examine the need for maintenance of the air conditioner off-site and, if needed, can travel to the air conditioner installation site with equipment necessary for maintenance provided in advance. Accordingly, the maintenance workability is improved.

Effects of the Invention

In the control device according to the first aspect of the present invention, at the time of occurrence of an error of the air conditioner, it is easy to determine whether the error occurred due to multiple factors or due to external factors. Further, even if there is no error, if an indication of occurrence of an error is detected, it is possible to perform maintenance in advance.

In the control device according to the second aspect of the present invention, the microcomputer sequentially updates, from oldest to new, the operation information of the air conditioner stored in the memory. Accordingly, the size of the memory capacity to be used is prevented from becoming large.

In the control device according to the third aspect of the present invention, the microcomputer causes the memory to store the time series of ambient temperature in case of occurrence of an error in the air conditioner. Accordingly, it is possible to estimate a change in the behavior of electronic components associated with a temperature change, and this simplifies the narrowing down of error factors.

In the control device according to the fourth aspect of the present invention, the microcomputer causes the memory to store the time series of the reception error occurrence rate in case of occurrence of an error in the air conditioner. This simplifies the narrowing down of factors at the time of occurrence of an error in the signal transmission system.

In the control device according to the fifth aspect of the present invention, memory contents will not be lost even if the power supply is interrupted.

In the control device according to the sixth aspect of the present invention, the service provider can examine the need for maintenance of the air conditioner and, if needed, can visit the air conditioner installation site with equipment necessary for maintenance provided in advance. Accordingly, the maintenance workability is improved.

DETAILED DESCRIPTION OF THE INVENTION

Structure of the Air Conditioner

Figure 1:
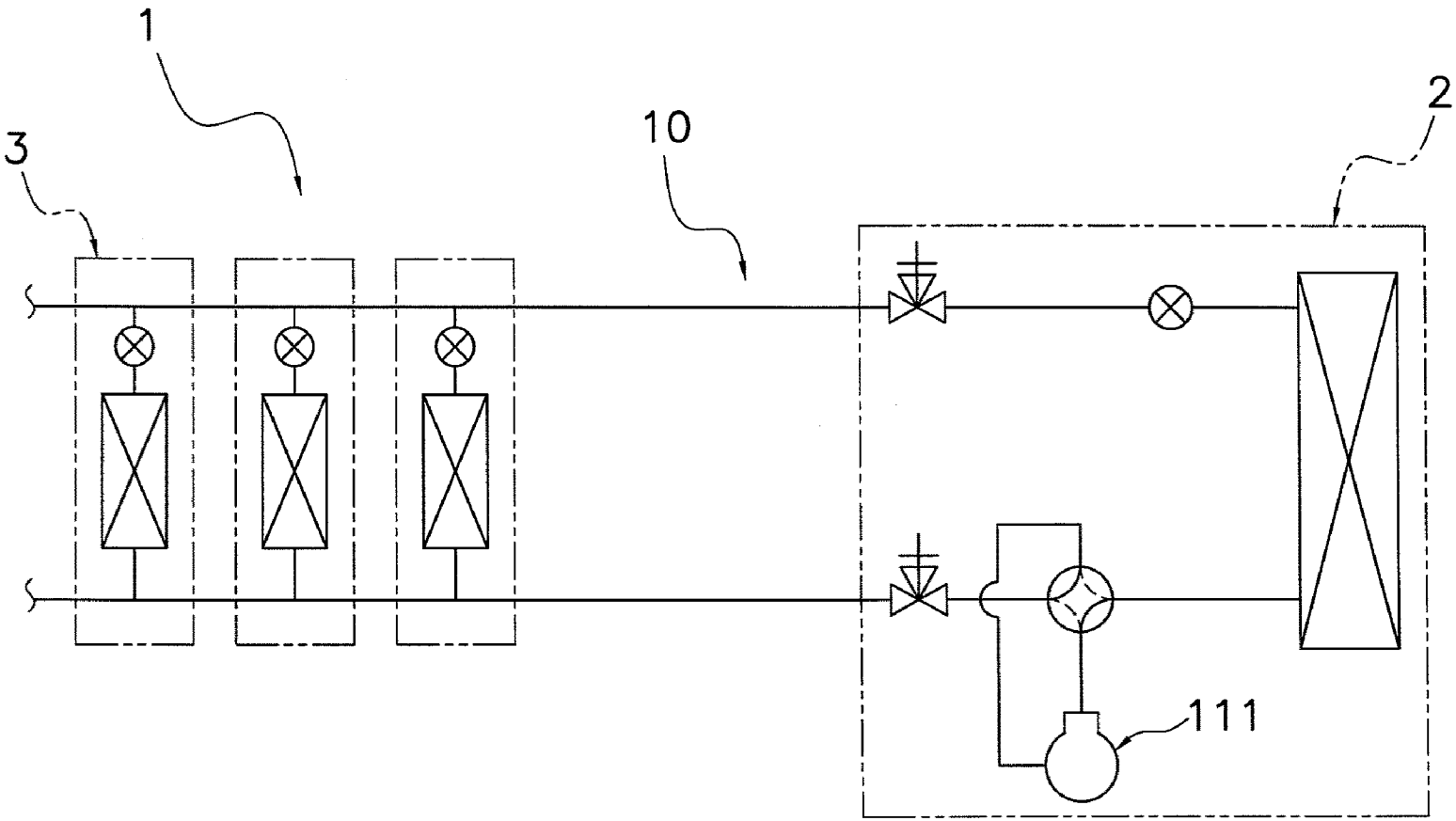
FIG. 1 is a configuration diagram of an air conditioner.

FIG. 1 is a configuration diagram of an air conditioner.

An air conditioner 1 is a multi-type air conditioner for a building, in which a plurality of air conditioner indoor units 3 are connected in parallel to one or a plurality of air conditioner outdoor units 2, and a refrigerant circuit 10 is formed by the interconnection of devices such as a compressor 111 and the like such that the refrigerant can circulate therethrough.

Figure 2A:
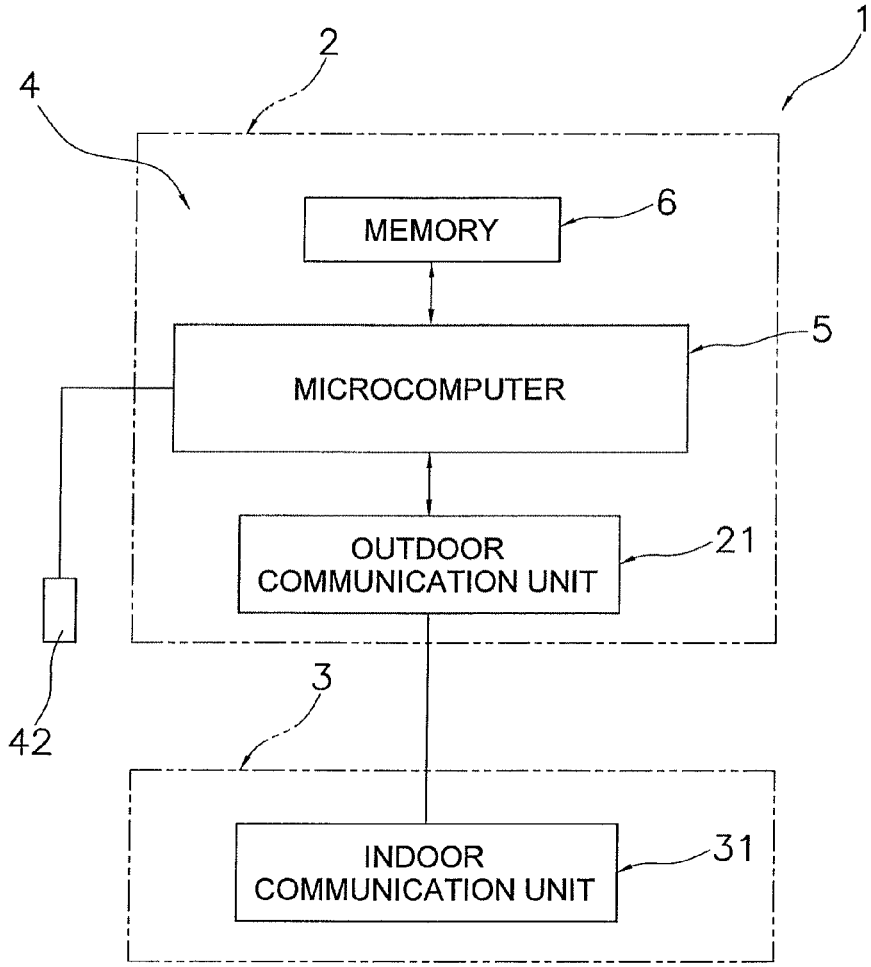
FIG. 2(*a*) is a block diagram of a control device according to an embodiment of the present invention, and FIG. 2(*b*) is an enlarged view of a memory.
Figure 2B:
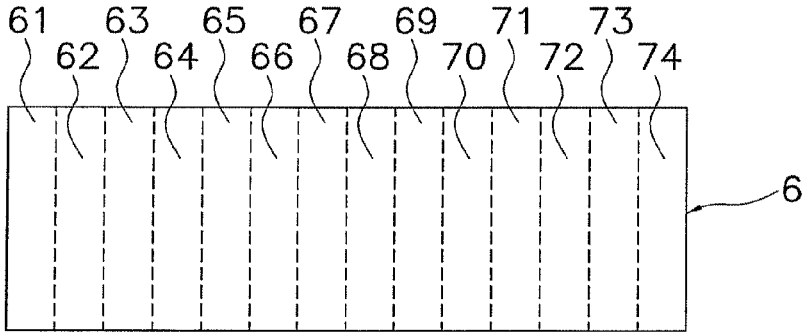

FIG. 2(*a*) is a block diagram of a control device according to the present embodiment, and FIG. 2(*b*) is an enlarged view of a memory. Each air conditioner outdoor unit 2 has an outdoor communication unit 21 and each air conditioner indoor unit 3 has an indoor communication unit 31, and these communication units 21 and 31 are capable of transmitting and receiving signals with each other. A control device 4 is equipped with a microcomputer 5, a storage element (memory) 6, and the outdoor communication unit 21. The microcomputer 5 causes a signal to be transmitted and received between the outdoor communication unit 21 and the indoor communication unit 31, and causes the memory 6 to store the state of transmission and reception of the signal and the operation information of the air conditioner 1. The memory 6 has 14 areas 61 to 74, and specific operation information is sequentially written in the areas starting from the area 61 to the area 74 at a constant time interval. When the area 74 is used, the operation information in the areas is sequentially overwritten starting from the area 61. Note that the memory 6 is nonvolatile, and thus memory contents will not be lost even if the power supply is interrupted.

In addition, the microcomputer 5 monitors the ambient temperature at a place where the control device 4 is disposed via a temperature sensor 42. Note that the temperature sensor 42 may be substituted by an outdoor temperature sensor that detects the outdoor temperature at a place where the air conditioner 1 is installed. Note that the control device 4 has many pieces of equipment (not shown) connected thereto besides the temperature sensor 42, however, the description thereof will be omitted.

<Error Indication Data Writing/Reading System>

A system to store, in the memory 6, an indication of occurrence of an error as data in the air conditioner 1 is incorporated in this embodiment. This system is called an error indication data writing/reading system. The "error indication data" herein is the operation information stored at a constant time interval in case of occurrence of an error in the air conditioner 1, and this data allows observation of a temporal change in the operation information.

Figure 3A:
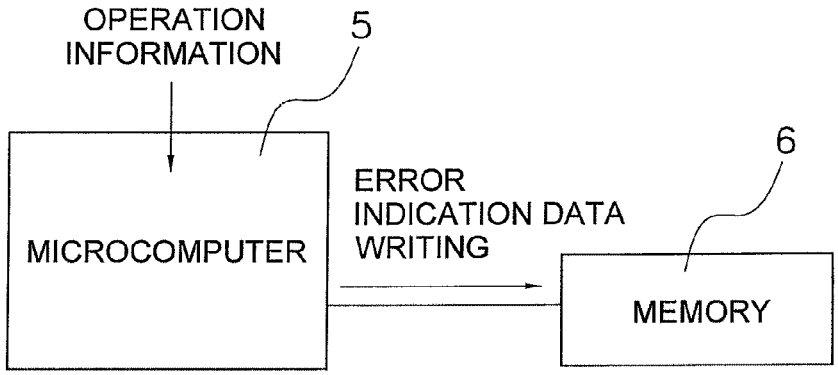
FIG. 3(*a*) is an image of an error indication data writing system, and FIG. 3(*b*) is an image of an error indication data reading system.
Figure 3B:
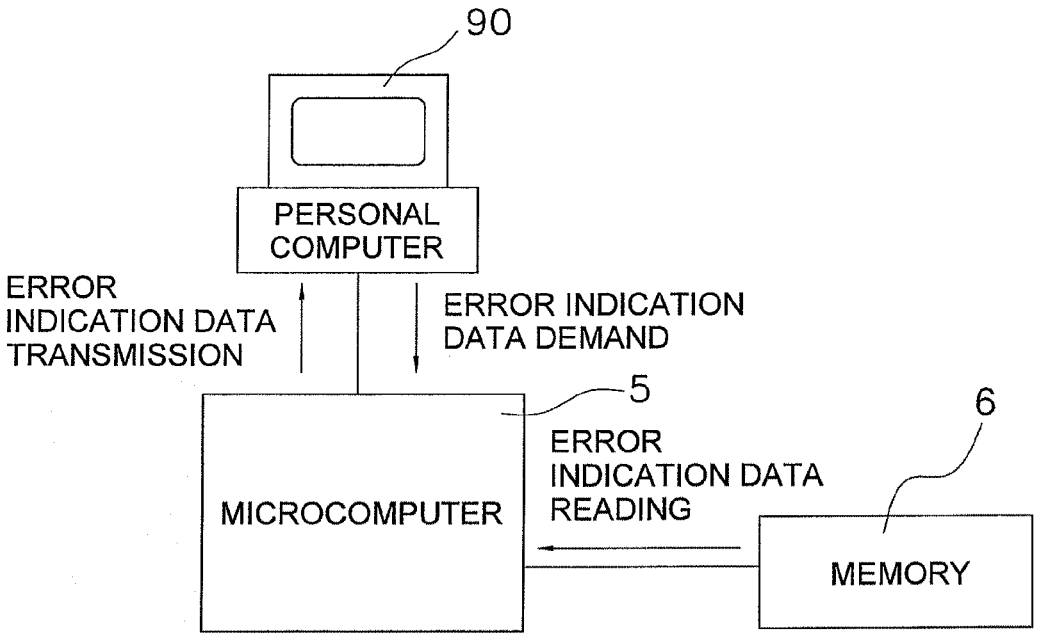

FIG. 3(*a*) is an image of an error indication data writing system. The microcomputer 5 sequentially writes specific operation information in the areas 61 to 74 of the memory 6 on an hourly basis, and all the areas are filled up in 14 hours. The information in the fifteenth hour overwrites the information in the area 61. Thus, when the air conditioner 1 is abnormally stopped, the specific operation information at least up to 13 hours prior to the abnormal stoppage is stored as the error indication data in the memory 6.

FIG. 3(*b*) is an image of an error indication data reading system. When a service provider uses a portable terminal (for example, a portable personal computer 90) to demand error indication data from the microcomputer 5 in order to analyze error factors in the air conditioner 1 that was abnormally stopped, the microcomputer 5 reads the error indication data stored in the memory 6 and sends it to the personal computer 90.

<Error Indication Data>

(Reception Error Occurrence Rate)

As the subject of observation, the error indication data writing/reading system observes a physical quantity (for example, ambient temperature) that is constantly monitored by the control device 4 and a result of an operation frequently performed by the air conditioner 1 (for example, state of transmission and reception of a command signal). Conventionally, when the air conditioner 1 is abnormally stopped, an error code is displayed on a display of a remote control, so that it is possible to analyze factors to a certain degree. However, it is not possible to determine whether the error was caused by external factors or by multiple factors including degradation. In particular, when an error occurred in information transmission (hereinafter referred to as "in-and-out transmission") between the air conditioner outdoor units 2 and the air conditioner indoor units 3, it is very difficult to analyze error factors. Therefore, in this embodiment, outdoor temperature and a reception error occurrence rate on the air conditioner outdoor units 2 side are subject to observation of the error indication data.

The microcomputer 5 causes a signal to be transmitted and received between the outdoor communication unit 21 provided to the air conditioner outdoor units 2 and the indoor communication unit 31 provided to the air conditioner indoor units 3. When the outdoor communication unit 21 fails to normally receive data for 15 seconds, it is counted a reception error. Additionally, the microcomputer 5 calculates a reception error occurrence rate from the number of times that the outdoor communication unit 21 received data in one hour and the number of reception errors that occurred in the same one hour, and then causes the memory 6 to store the reception error occurrence rate. At the same time, the microcomputer 5 causes the memory 6 to store an output value of the temperature sensor 42 on an hourly basis.

(Error Indication Data Writing Control)

Figure 4:
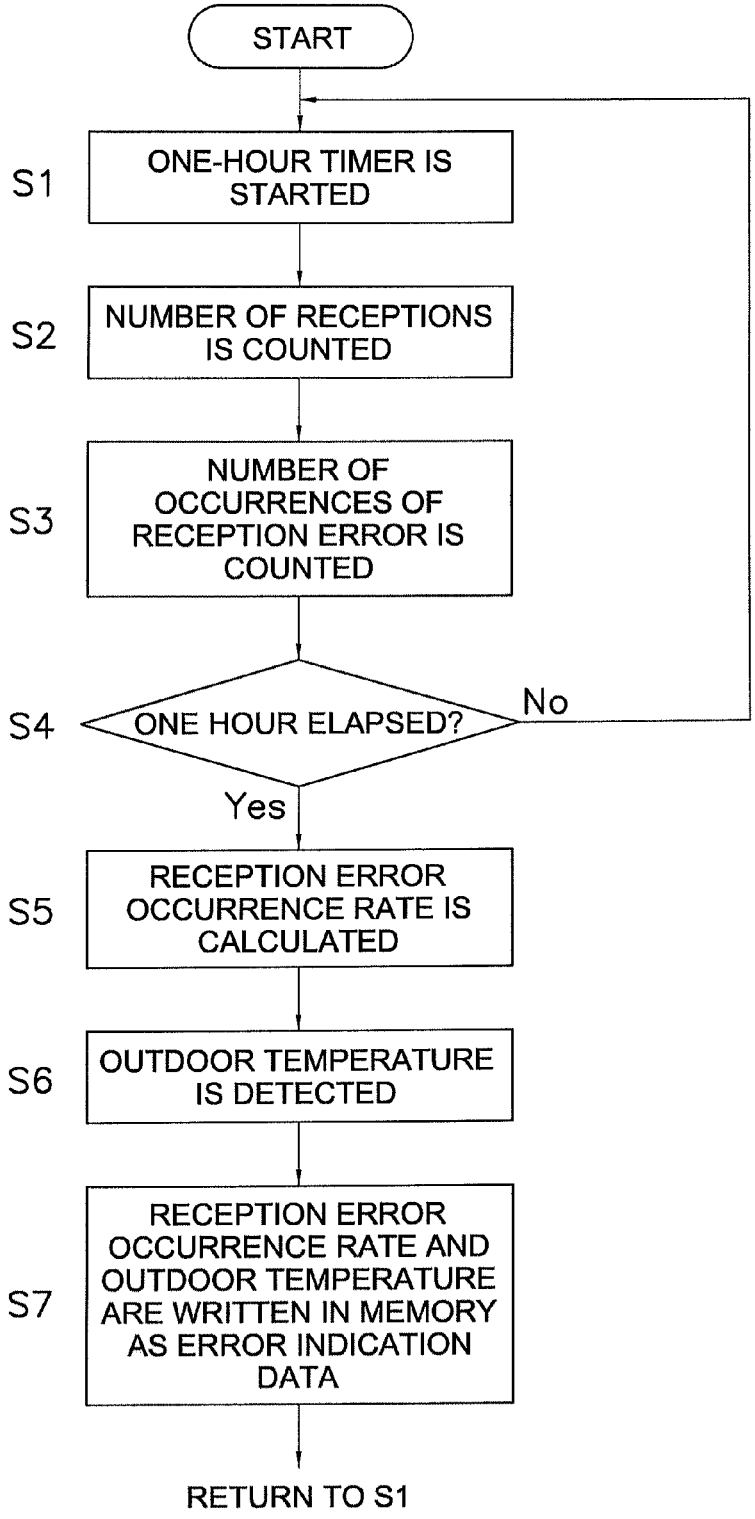
FIG. 4 is a flowchart of error indication data writing control.

FIG. 4 is a flowchart of error indication data writing control. The microcomputer 5 starts a one-hour timer in step S1, and counts how many times the outdoor communication unit 21 received a signal from the indoor communication unit 31 in step S2. In step S3, the microcomputer 5 counts how many times the outdoor communication unit 21 failed to normally receive a signal. In this embodiment, the state in which the outdoor communication unit 21 failed to normally receive a signal from the indoor communication unit 31 for 15 seconds is counted as the number of occurrences of a reception error.

The microcomputer 5 judges in step S4 whether or not one hour has elapsed, and if one hour has elapsed, calculates the reception error occurrence rate in step S5.

Note that, the reception error occurrence rate=the number of occurrences of a reception error/the number of receptions. If one hour has not elapsed, the flow returns to step S1.

The microcomputer 5 detects the outdoor temperature in step S6. In step S7, the microcomputer 5 writes the reception error occurrence rate calculated in step S5 and the outdoor temperature detected in step S6 in the memory 6 as error indication data.

The reception error occurrence rate and the outdoor temperature are sequentially written in the areas 61 to 74 of the memory 6 on an hourly basis, and all the areas 61 to 74 are filled up in 14 hours. The information in the fifteenth hour overwrites the information in the area 61. Thus, when the air conditioner 1 is abnormally stopped, the reception error occurrence rate and the outdoor temperature at least up to 13 hours prior to the abnormal stoppage are stored as the error indication data in the memory 6.

(Error Indication Data Reading Control)

Figure 5:
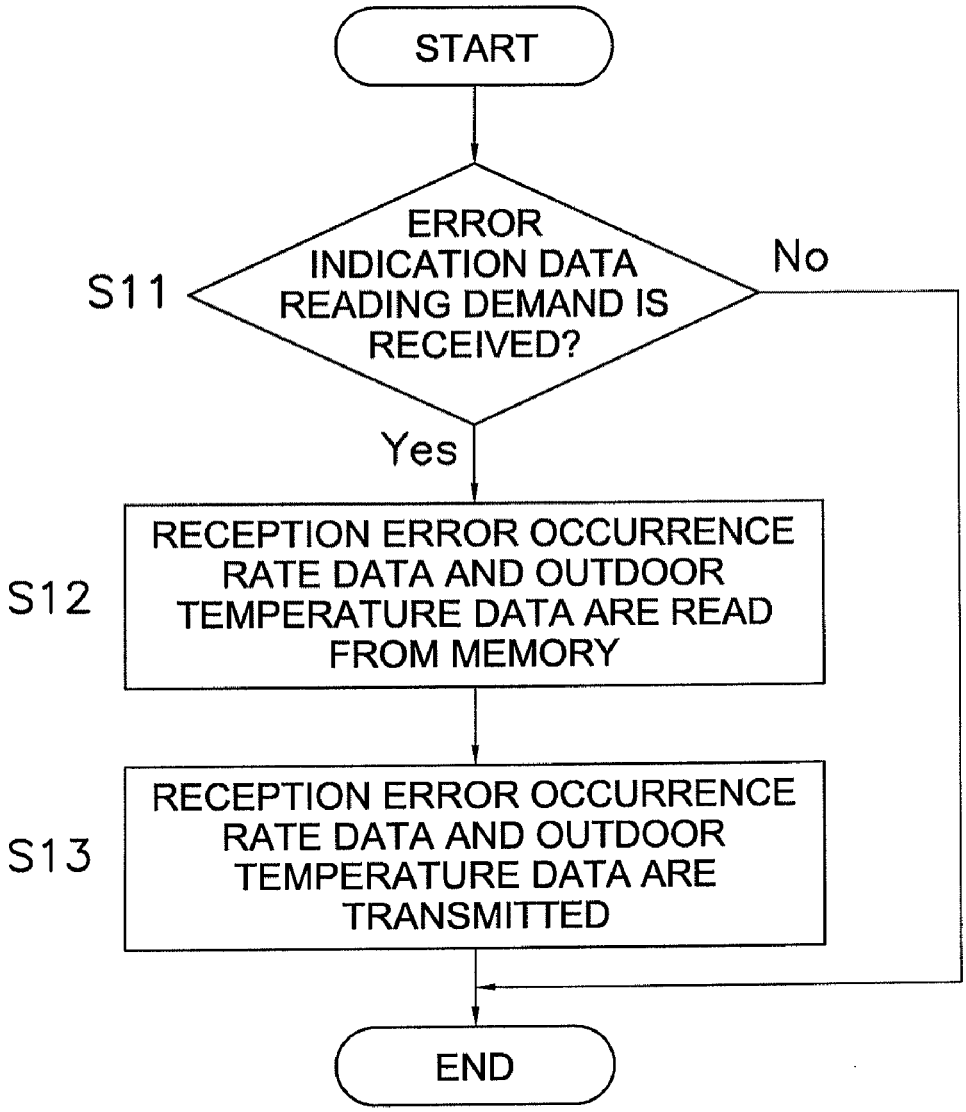
FIG. 5 is a flowchart of error indication data reading control.

FIG. 5 is a flowchart of error indication data reading control. When the air conditioner 1 is abnormally stopped, a service provider travels to the air conditioner installation site, and transmits an error indication data demand signal to the microcomputer 5 using the personal computer 90 that is a portable terminal. The microcomputer 5 receives the error indication data demand signal in step S11. In step S12, the microcomputer 5 reads the reception error occurrence rate data and the outdoor temperature data as the error indication data from the memory 6, and in step S13, transmits the data read in step S12 to the personal computer 90 of the service provider.

The service provider obtains the reception error occurrence rate and the outdoor temperature on an hourly basis up to 13 hours prior to the abnormal stoppage, and analyzes factors contributing to the error. For example, there is a case where the outdoor communication unit 21 generates a reception error due to noise effects. Note that, because the occurrence of noise is accidental, the noise is considered to be a factor when there is no regularity or no increase tendency in the reception error occurrence rate.

On the other hand, when there is regularity or increase tendency in the reception error occurrence rate, it is likely that the degradation of electronic components such as the outdoor communication unit 21 is advanced. The electronic components are particularly susceptible to the ambient temperature, and thus it is possible to identify whether the error was caused by a failure in electronic components or the error was caused as a result of the degradation of electronic components induced by the outdoor temperature change, by comparing the time series of the reception error occurrence rate to the time series of outdoor temperature.

<Characteristics>

(1)

The control device 4 is a control device that controls the air conditioner 1 configured by the air conditioner outdoor units 2 and the air conditioner indoor units 3, and includes the microcomputer 5 and the memory 6. The microcomputer 5 causes a signal to be transmitted and received between the outdoor communication unit 21 provided to the air conditioner outdoor units 2 and the indoor communication unit 31 provided to the air conditioner indoor unit 3. The microcomputer 5 calculates the reception error occurrence rate based on the number of times that the outdoor communication unit 21 failed to normally receive a signal from the indoor communication unit 31 in one hour, and causes the memory 6 to store the reception error occurrence rate as the error indication data. At the same time, the microcomputer 5 causes the memory 6 to store an output value of the temperature sensor 42 on an hourly basis. Accordingly, the time series of the reception error occurrence rate and the time series of the outdoor temperature are accumulated as data, and it is possible, based on the trend of the data, to easily determine whether the error was caused by multiple factors or by external factors.

(2)

In the control device 4, the reception error occurrence rate and the outdoor temperature are sequentially written in the areas 61 to 74 of the memory 6 on an hourly basis, and all the areas 61 to 74 are filled up in 14 hours. The information in the fifteenth hour overwrites the information in the area 61. Thus, when the air conditioner 1 is abnormally stopped, the reception error occurrence rate and the outdoor temperature at least up to 13 hours prior to the abnormal stoppage are stored as the error indication data in the memory 6. Accordingly, there is no need to increase the size of the memory capacity to be used, and thus it is economical.

(3)

In the control device 4, the memory 6 is nonvolatile, and thus memory contents will not be lost even if the power supply is interrupted.

Alternative Embodiment

While the present invention has been described, the specific configuration is not limited to the above-described embodiment, and various changes and modifications can be made herein without departing from the scope of the invention.

For example, when the microcomputer 5 writes the error indication data in the memory 6, the microcomputer 5 may transmit the error indication data to a central control center where the operation state of the air conditioner 1 is collectively controlled. The central control center can analyze the possibility of occurrence of an error in the air conditioner 1 in the future based on the error indication data transmitted, and can take countermeasures in advance.

In addition, the service provider of the air conditioner 1 may read the error indication data via a wireless communication from a remote location. Accordingly, the service provider can travel to the air conditioner installation site with all the equipment necessary for maintenance of the air conditioner 1, and thus the maintenance workability is improved.

INDUSTRIAL APPLICABILITY

As described above, the present invention simplifies factor analysis when an error occurs in an air conditioner, and thus is useful to an air conditioner control device.

What is claimed is:

1. A control device configured to control an air conditioner that includes an air conditioner outdoor unit and an air conditioner indoor unit, the control device comprising:

a microcomputer configured to cause a signal to be transmitted and received between an outdoor communication unit of the air conditioner outdoor unit and an indoor communication unit of the air conditioner indoor unit; and a storage element configured to store predetermined information in response to a command from the microcomputer, the microcomputer being configured to cause the storage element to store operation information including a state of transmission and reception of the signal of the air conditioner at a constant time interval within a 24 hour period, and the operation information including a reception error occurrence rate calculated by dividing a number of times that the outdoor communication unit failed to normally receive a signal from the indoor communication unit at the constant time interval by a total number of times that the outdoor communication unit received a signal from the indoor communication unit at the constant time interval.

2. The control device according to claim 1, wherein the storage element includes a predetermined number of areas configured to store the operation information, and the microcomputer is configured to write new operation information in the area storing oldest operation information in an overwriting manner if all the areas are being used to store operation information when the microcomputer causes the storage element to store new operation information.

3. The control device according to claim 1, wherein the operation information includes ambient temperature where the microcomputer and the storage element are disposed.

4. The control device according to claim 1, wherein the storage element includes nonvolatile memory.

5. The control device according to claim 1, wherein the microcomputer is configured to transmit the operation information to a terminal device located remote from the air conditioner.

* * * * *